US005577940A

United States Patent [19]

Adler

[11] Patent Number: 5,577,940

[45] Date of Patent: Nov. 26, 1996

[54] WATER CYCLE APPARATUS

[76] Inventor: Constance Adler, 1297 Woodland West, Waco, Tex. 76712

[21] Appl. No.: 604,827

[22] Filed: Feb. 23, 1996

[51] Int. Cl.[6] ..... B63H 16/20

[52] U.S. Cl. ..... 440/27; 441/130

[58] Field of Search ..... D12/306; 440/21, 440/26–30, 90; 441/129, 130; 482/57, 58, 111; 472/128, 129

[56] References Cited

U.S. PATENT DOCUMENTS

| | | | |
|---|---|---|---|
| D. 96,906 | 9/1935 | Custer . | |
| D. 187,357 | 3/1960 | Silva . | |
| D. 220,222 | 3/1971 | Nolet et al. . | |
| D. 241,327 | 9/1976 | Compton . | |
| D. 290,594 | 6/1987 | Lacasse . | |
| D. 321,854 | 11/1991 | Foley et al. . | |
| D. 345,136 | 3/1994 | Schlangen et al. . | |
| 1,920,391 | 8/1933 | Herwig | 440/30 |
| 4,496,325 | 1/1985 | Tweg . | |
| 5,308,268 | 5/1994 | Schmid . | |

FOREIGN PATENT DOCUMENTS

| | | | |
|---|---|---|---|
| 310317 | 10/1917 | Germany | 440/30 |

*Primary Examiner*—Edwin L. Swinehart
*Attorney, Agent, or Firm*—Arthur F. Zobal

[57] ABSTRACT

The apparatus has front and rear floatable members. A main shaft is fixedly coupled to the rear end of the front member and extends upward wherein it has an upper portion defining a pivot axis. A connecting member is fixedly coupled to the front end of the rear member and extends forward and upward. The connecting member has a forward connecting portion comprising an aperture through which the upper portion of the main shaft extends such that the two members may turn relative to each other. Handle bars are connected to the main shaft. A seat is coupled to the rear member for supporting a person. Paddles having inner ends are coupled to a paddle shaft. A support is coupled to the front member for supporting the paddle shaft and paddles for rotation about a paddle axis transverse to the pivot axis. Pedals are coupled to the paddle shaft for rotating the paddles shaft and hence the paddles for movement of the outer ends of the paddles through the water below the paddle shaft for moving the apparatus in the water.

4 Claims, 5 Drawing Sheets

WATER CYCLE APPARATUS

BACKGROUND OF THE INVENTION

1. Field of the Invention

The invention relates to a water apparatus having foot operated pedals for rotating paddles for moving the apparatus in water.

2. Description of the Prior Art

U.S. Pat. No. 5,308,268 discloses a water cycle having a front floatable member and two rear floatable members with the front and rear members pivotally coupled together. Pedals coupled to paddles by way of a chain are supported on the rear member for use for moving the apparatus in the water.

SUMMARY OF THE INVENTION

The invention comprises a front and rear floatable members pivotally coupled together with pedals supported on the front member for operating paddles also supported on the front member for use for moving the apparatus in the water.

In the embodiment disclosed, a main shaft is fixedly coupled to the rear end of the front member and extends upward wherein it has an upper portion defining a pivot axis. A connecting member is fixedly coupled to the front end of the rear member and extends forward and upward. The connecting member has a forward connecting portion comprising an aperture through which the upper portion of the main shaft extends such that the two members may mm relative to each other. Handle bars are connected to the main shalt A seat is coupled to the rear member for supporting a person. Paddles are coupled to a paddle shaft. Support means is coupled to the front member for supporting the paddle shaft and paddles for rotation about a paddle axis transverse to the pivot axis. Pedals are coupled to the paddle shaft for rotating the paddles shaft and hence the paddles for movement of the outer ends of the paddles through the water below the paddle shaft for moving the apparatus in the water.

In the preferred embodiment, the main shaft extends rearward and upward from the rear end of the front member.

DESCRIPTION OF THE PREFERRED EMBODIMENT

Figure 1:
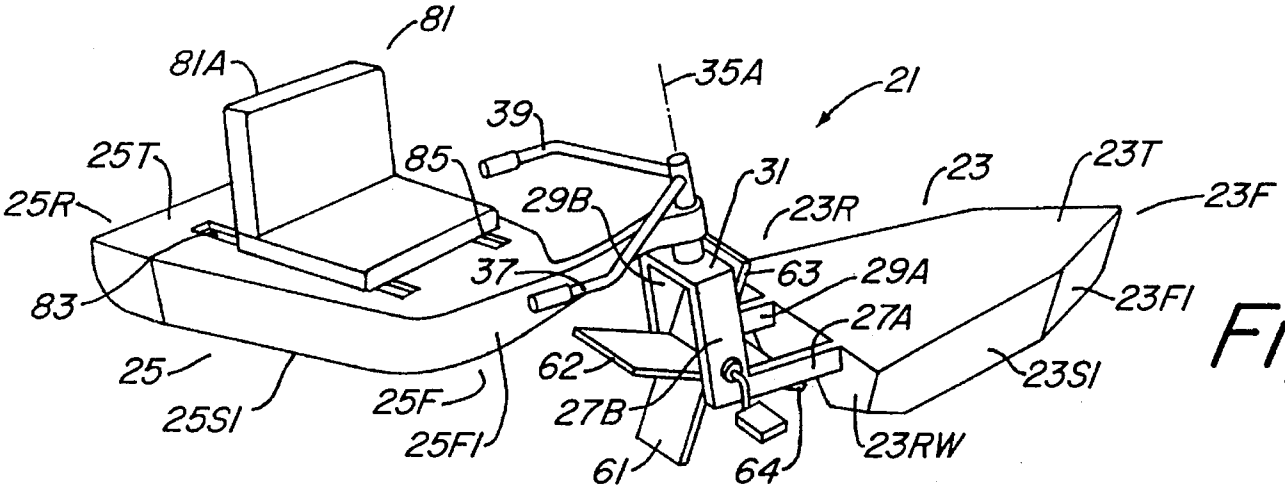
FIG. 1 is a right side view of the apparatus of the invention with the front and rear members turned relative to each other.
Figure 2:
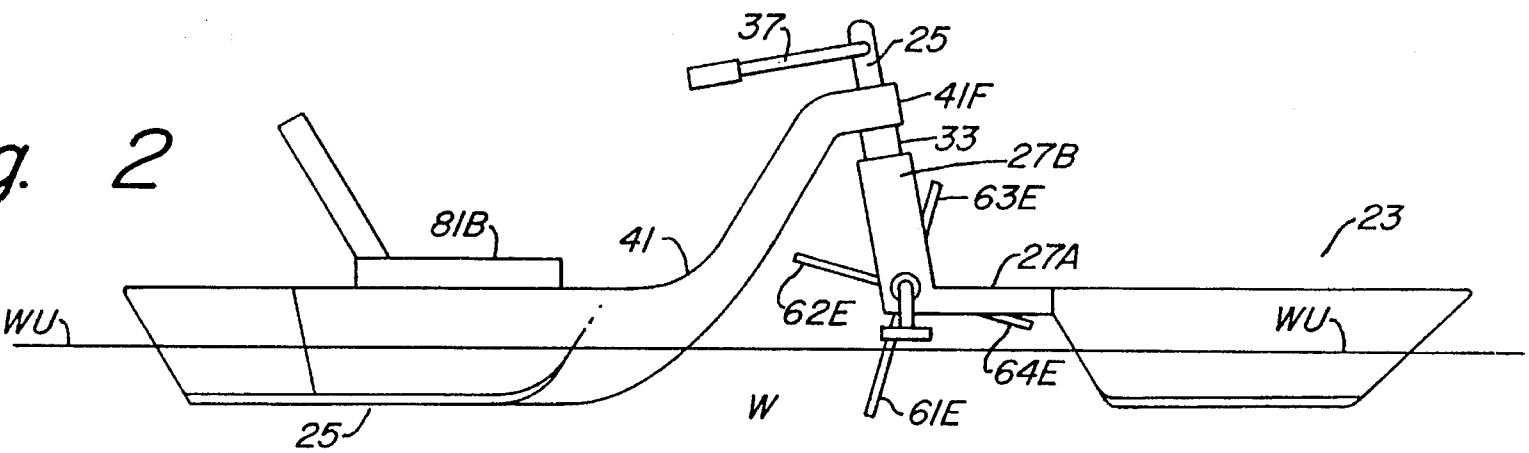
FIG. 2 is a side view of the apparatus of FIG. 1.
Figure 3:
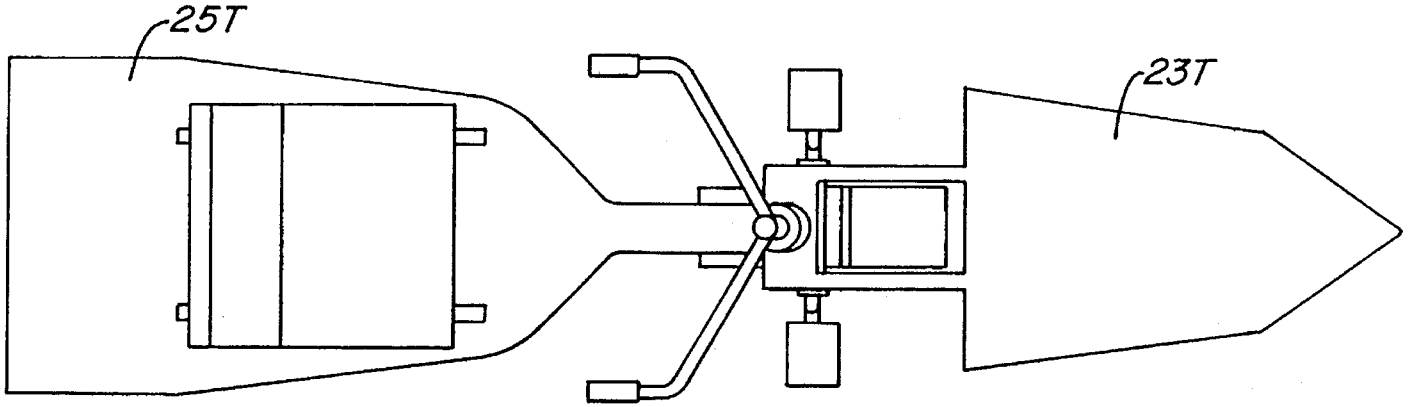
FIG. 3 is a top plan view of the apparatus of FIG. 1.
Figure 4:
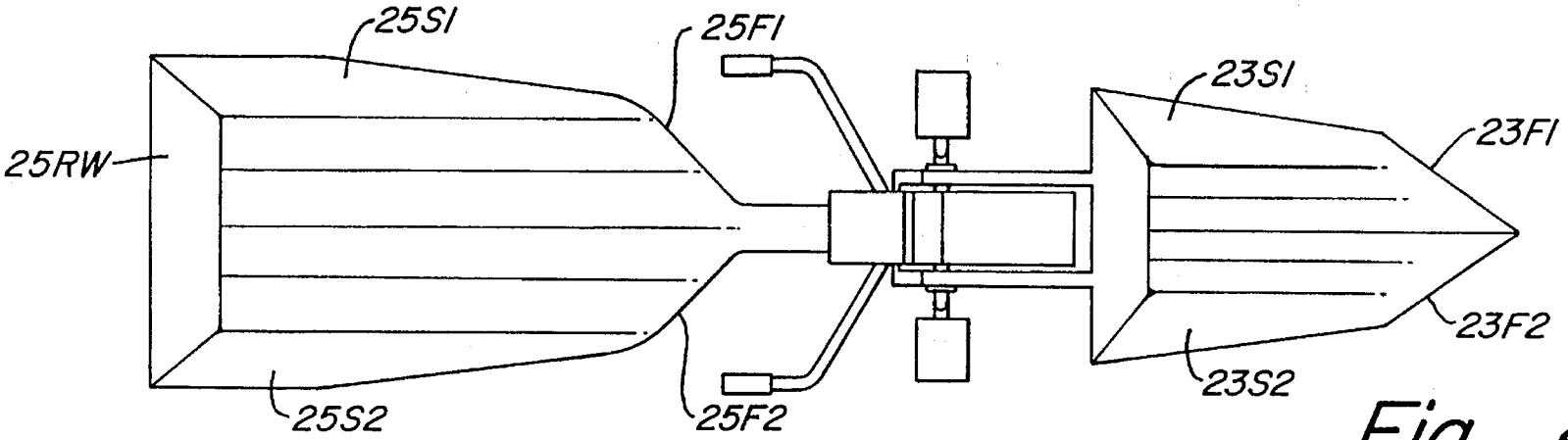
FIG. 4 is a bottom plan view of the apparatus of FIG. 1.
Figure 5:
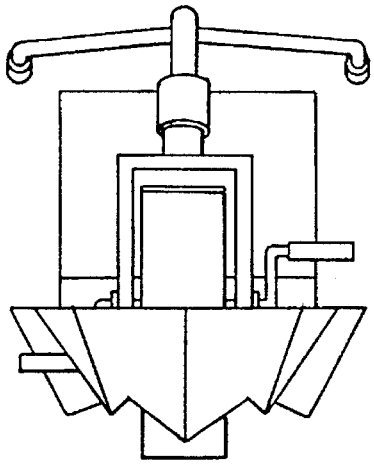
FIG. 5 is a front elevational view of the apparatus of FIG. 1.
Figure 6:
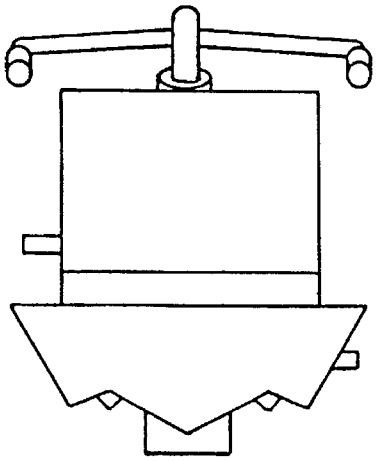
FIG. 6 is a rear elevational view of the apparatus of FIG. 1.
Figure 7:
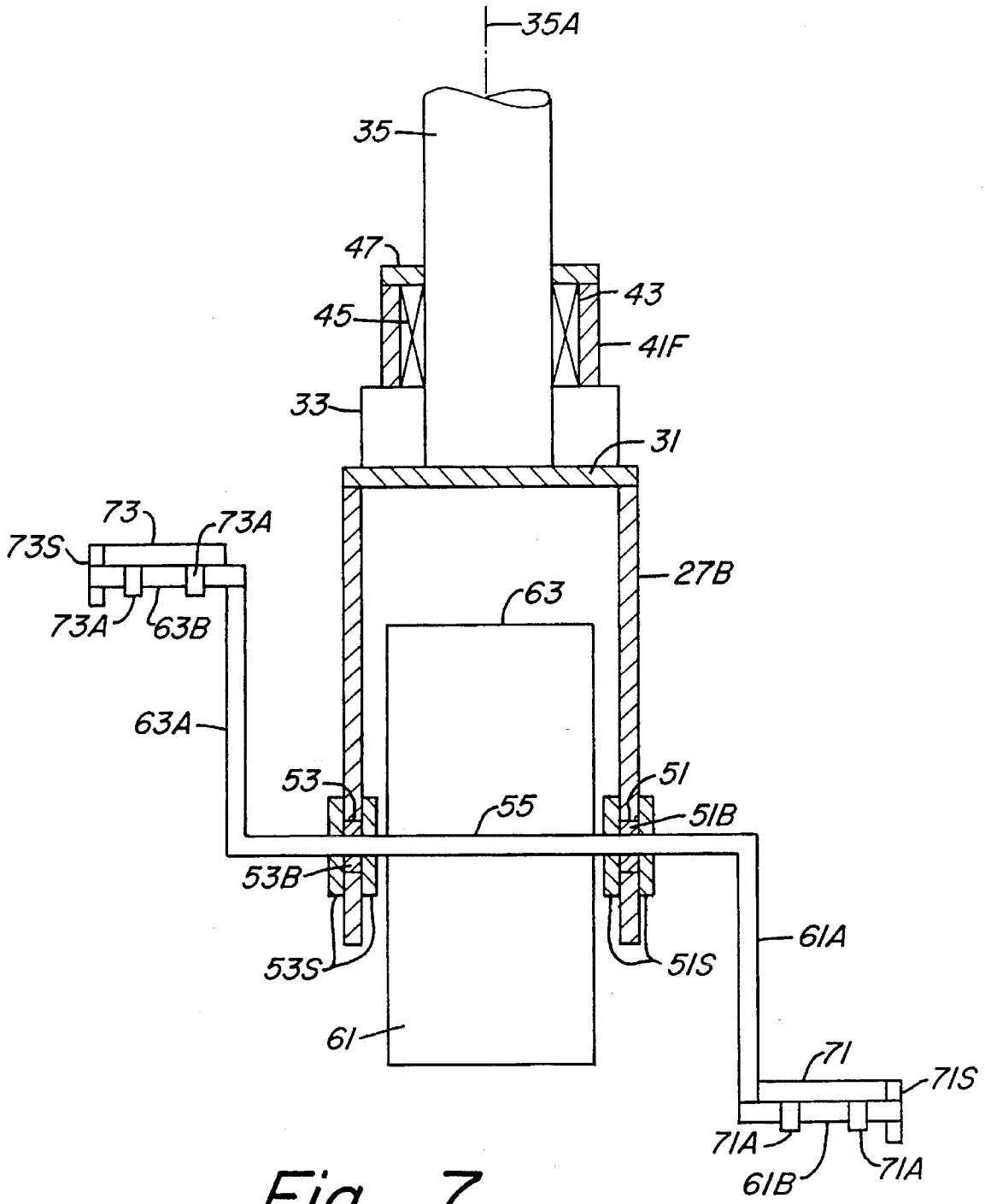
FIG. 7 is an enlarged view of the main shaft and pedal and paddle mechanism of the apparatus of the invention.

Referring now to the drawings the water cycle apparatus of the invention is identified at 21. It comprises a front floatable member 23 having a front end 23F and a rear end

23R and a rear floatable member 25 having a front end 25F and a rear end 25R. Member 23 and 25 are constructed to float in water W. The front member 23 comprises a top wall 23T, a bottom wall 23B, a rear wall 23RW, two side walls 23S1 and 23S2 and a front wall 23F1 and 23F2 defining a hollow cavity filled with a material such as Styrofoam. The rear member 25 comprises a top wall 25T, a bottom wall 25B, a rear wall 25RW, two side walls 25S1 and 25S2 and a front wall 25F1 and 25F2 defining a hollow cavity filled with a material such as Styrofoam. The walls of members 23 and 25 may be formed of a suitable metal or plastic.

Members 23 and 25 may be molded as solid members from a suitable buoyant material.

Secured to the rear wall 23RW of member 23 are two spaced apart support members 27A and 29A which extend rearward and then upward and rearward at 27B and 29B. An upper cross member 31 is connected to the upper ends of members 27B and 29B.

The cross member 31 supports a cylindrical member 33 having an upper cylindrical shaft 35 which extends upward and rearward defining a pivot axis 35A. Secured to the top of the shaft 35 are two handle bars 37 and 39.

The front 25F of the member 25 has a connecting member 41 connected thereto which extends forward and upward with an aperture 43 formed through the forward end 41F for receiving the shaft 35. An annular beating 45 is provided in the aperture 43 for engaging the shaft 25. An annular member 47 is secured to the shaft 35 to hold the front end 41F of connecting member 41 against the member 33.

The shaft 35 may be turned or pivoted to the left or right in the aperture 43 of the connecting member 41 to turn the front member 23 to the left or right relative to the rear member 25.

Apertures 51 and 53 are formed through the support members 27A, 27B and 29A, 29B for receiving a cylindrical paddle shaft 55 which extends transverse relative to the pivot shaft 35A and which is horizontal to the upper level WU of the water W when the members 23 and 25 are located in a body of water. Members 51B and 53B are annular bearings and members 51S and 53S are annular members secured to the shaft 55 for maintaining the shaft 55 and bearings in the apertures 51 and 53 as shown.

Secured to the shaft 55 inside the support members 27A, 27B and 29A, 29B are the inner ends of four paddles 61–64 with adjacent paddles being located 90 degrees apart.

Coupled to the outer ends of the shaft 55 are L-shaped rods 61A, 61B and 63A, 63B which are located 180 degrees apart.

Rod members 61B and 63B are transverse to rod members 61A and 63A respectively and support foot rests 71 and 73 respectively. Foot rest 71 has annular members 71A secured thereto through which member 61B extends to allow the foot rest 71 to rotate about rod member 61B. An annular member 71S is secured to the end of rod member 61B to maintain the foot rest 71 in place. Foot rest 73 has annular members 73A secured thereto through which member 63B extends to allow the foot rest 73 to rotate about rod member 63B. An annular member 73S is secured to the end of rod member 63B to maintain the foot rest 73 in place.

The paddle shaft 55 is located above the top surface of the water such that as one rotates the pedals 61A, 61B, 71 and 63A, 63B, 73 the outer ends 61E–64E of the paddles 61–64 enter and then leave the water to move the front member 23 and hence the rear member 25 forward or rearward depending on which direction one rotates the pedals.

A seat 81 is provided on the rear member 25 to support a person such that his or her legs may operate the pedals while his or her arms grasp the handle bars 37 and 37 to guide the apparatus in the water. The position of the seat may be adjusted forward or rearward relative to the rear member 25.

Figure 8:
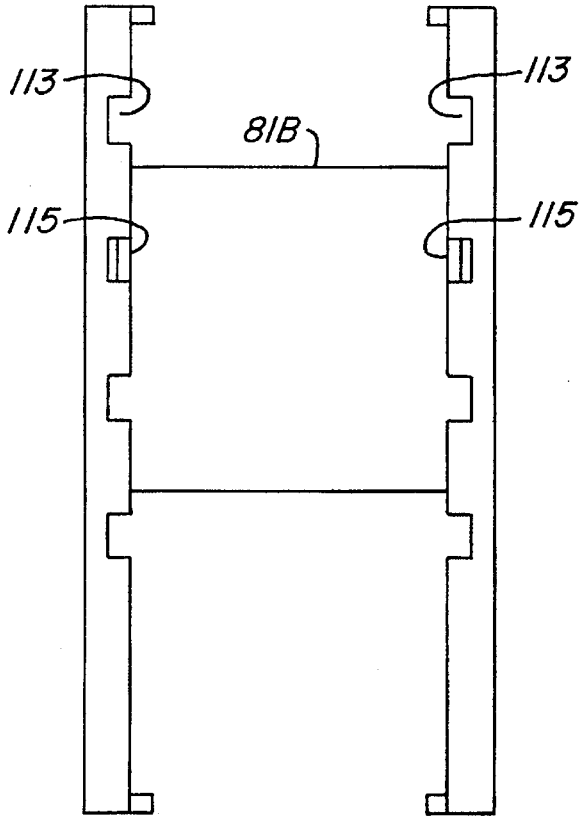
FIGS. 8 and 9 illustrate an embodiment for slidably holding the seat in place.
Figure 11:
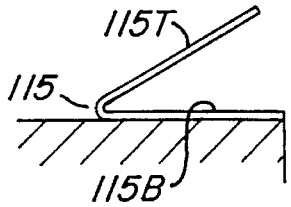
FIGS. 10 and 11 illustrate a spring clip in compressed and expanded positions respectively.
Figure 10:
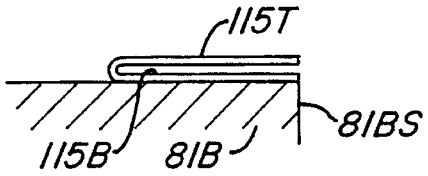
Figure 9:
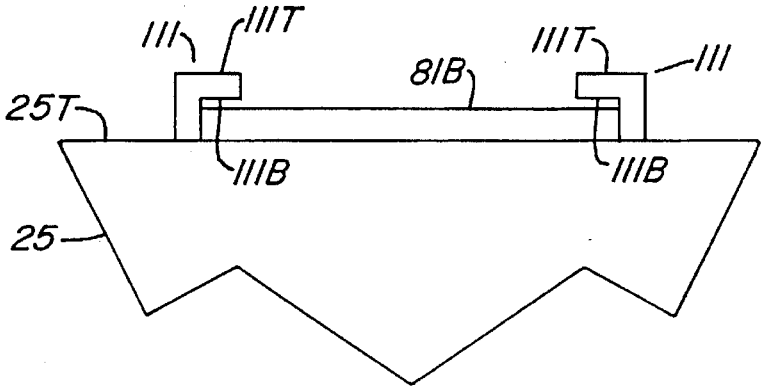

Referring to FIGS. 8–11, two L-shaped tracks 111 are attached to the top 25T of member 25. Slots 113 are formed in the tracks 111. Two metal spring members 115 are attached to the seat 81B on opposite sides thereof below the bottom surfaces 111B of the top edges 111T of the tracks 111. Each member 115 has a bottom member 115B and a top member 115T. The bottom members 115B are attached to the top of the seat member 81B on opposite sides thereof. In FIGS. 13 and 14 one side edge of the seat member 81B is shown at 81BS. The top members 115T can be pushed down to locate them below the lower surfaces 111B of the track edges 111T to allow the seat member 81B to be moved forward and rearward to different positions to align the pair of spring members 115 with a selected pair of the slots. The spring top members 115T then spring up in the selected pair of slots 113 to hold the seat member 81B in place.

Thus there is provided a simple and effective water cycle that can be operated manually by a person for movement in the water. It is very maneuverable since the pedals and paddles are on the front member and it can be turned in a small mining radius. Them is no chain which may otherwise get caught in vegetation, etc. in the water. There is a minimum of maintenance and it can be readily folded to a compact position for storage in a car or truck. The apparatus has a low center of gravity which makes it more stable and thus does not need a large width to prevent tipping. The low structure also makes it easy to mount.

Although a single floatable rear member 25 is shown, it is to be understood that two additional floatable rear members may be provided for more stability in rough water. In this modification the two floats may be attached to a frame which slides down over the seat back 81A, thus securing the floats to the rear member 25. This provides an easily attachable and removable stabilizer.

I claim:

1. A water cycle, comprising:

from and rear floatable members constructed to float in water, each of said members having a front end, a rear end and a top wall, a main shaft fixedly coupled to said rear end of said front member and extending upward above said top wall of said front member and having an upper portion defining a pivot axis, a connecting member fixedly coupled to said front end of said rear member and extending forward and upward, said connecting member having a forward connecting portion comprising an aperture through which said upper portion of said main shaft extends such that said front and rear members may turn relative to each other, handle bars connected to said main shaft above said forward connecting portion for use for turning said front member relative to said rear member, a paddle shaft, paddles having inner ends coupled to said paddle shaft and outer ends extending outward from said paddle shaft, support means coupled to said rear end of said front member for supporting said paddle shaft and said paddles for rotation about a paddle axis transverse to said main pivot axis, said support means supports said paddle shaft in a position such that as said paddles rotate, said outer ends of said paddles pass below said paddle shaft and enter and then leave the water as they are rotated, a seat coupled to said top wall of said rear member for supporting a person, and pedals coupled to said paddle shaft for operation by a person's feet for rotating said paddle shaft and said paddles for moving said front member and hence said rear member in the water.

2. The water cycle apparatus of claim 1, wherein:

said main shaft extends rearward and upward relative to said top wall of said front member.

3. The water cycle apparatus of claim 1, wherein:

said support means comprises, two spaced apart support members extending rearward from said rear end of said from member and then upward, said paddle shaft extends through said two support members with said paddles being connected to said paddle shaft for rotation between said two support members.

4. The water cycle apparatus of claim 2, wherein:

said support means comprises, two spaced apart support members extending rearward from said rear end of said front member and then upward, said paddle shaft extends through said two support members with said paddles being connected to said paddle shaft for rotation between said two support members.

* * * * *